US006817469B2

(12) United States Patent
Chang

(10) Patent No.: US 6,817,469 B2
(45) Date of Patent: Nov. 16, 2004

(54) GOLF CLUB BAG SUPPORT HAVING PIVOTAL SUPPORT MEMBERS

(76) Inventor: Shu-Chin Chang, 36, Lane 64, Tzu Chih Road, Ta Tu Village, Ta Tu Hsiang, Taichung-Hsien (TW)

( * ) Notice: Subject to any disclaimer, the term of this patent is extended or adjusted under 35 U.S.C. 154(b) by 0 days.

(21) Appl. No.: 10/268,702

(22) Filed: Oct. 11, 2002

(65) Prior Publication Data

US 2004/0069664 A1 Apr. 15, 2004

(51) Int. Cl.[7] ..... A63B 55/00; A63B 55/06; A63B 55/08

(52) U.S. Cl. ..... 206/315.7; 206/315.3; 248/96; 280/646; 280/DIG. 6

(58) Field of Search ..... 206/315.3, 315.7; 248/96; 280/47.26, 646, DIG. 6; D3/328.1

(56) References Cited

U.S. PATENT DOCUMENTS 1,197,298 A * 9/1916 McGregor ..... 248/96
1,320,620 A * 11/1919 Jenson ..... 248/96
1,681,225 A * 8/1928 Earl ..... 248/96
1,757,471 A * 5/1930 Platt ..... 248/96
1,840,663 A * 1/1932 Gallagher ..... 206/315.6
1,882,785 A * 10/1932 Doughty ..... 248/96
1,961,454 A * 6/1934 Reichhart ..... 248/96
4,302,029 A * 11/1981 Albertson ..... 280/646
5,082,218 A * 1/1992 Hoffman ..... 248/96
5,339,951 A * 8/1994 Chen ..... 206/315.7
5,356,003 A * 10/1994 Gretz et al. ..... 206/315.7
5,419,473 A * 5/1995 Lamar ..... 224/632
5,516,064 A * 5/1996 Hsieh ..... 248/96
5,586,778 A * 12/1996 Lindh et al. ..... 280/40
5,829,585 A * 11/1998 Kao et al. ..... 206/315.3
6,227,503 B1 * 5/2001 Shiao Chen ..... 248/96
6,386,362 B1 * 5/2002 Cheng ..... 206/315.3
6,443,405 B1 * 9/2002 Han ..... 248/96

* cited by examiner

*Primary Examiner*—Sue A. Weaver
(74) *Attorney, Agent, or Firm*—Rabin & Berdo, P.C.

(57) ABSTRACT

An improved structure golf club bag support comprised of two clevis sections disposed at intervals apart, furthermore, at an outwardly oriented included angle on the appropriate positions of the upper lateral edges and bottom mount sides; support members, each top and bottom ends support members connected to the clevis sections, each support member consisting of a primary and secondary sub-member; a coupling fixture at the center portion having hinge tabs connected to a linkage hole in each secondary sub-member; a positioning torque spring, having a linearly projecting upper and lower tip that are situated against each primary and secondary sub-member. When the golf club bag is inclined at the two clevis sections, pressure exerted onto the secondary sub-members and directed outward against the primary sub-members, at which time, the primary and the secondary sub-members are articulated into a rigid pyramidical state that provides for stable support.

3 Claims, 9 Drawing Sheets

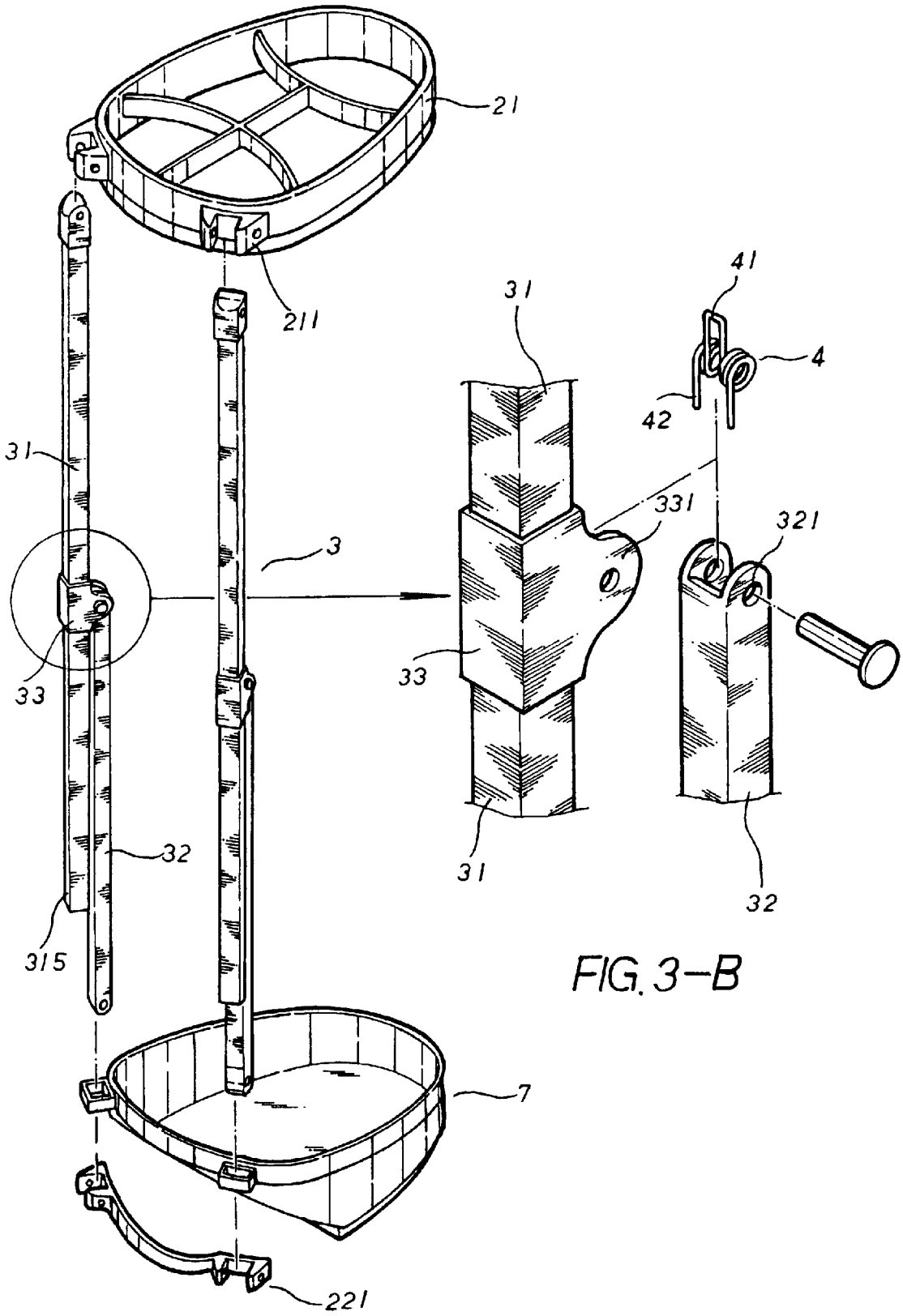
FIG. 3-B
FIG. 3-A

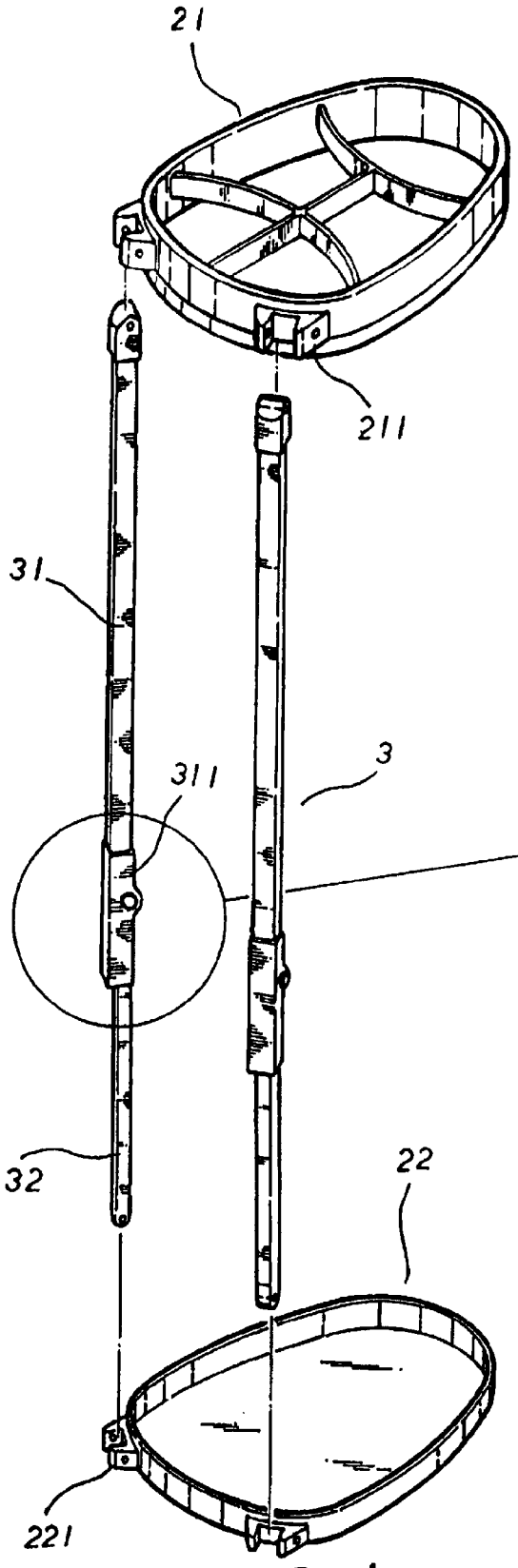
FIG. 6-A
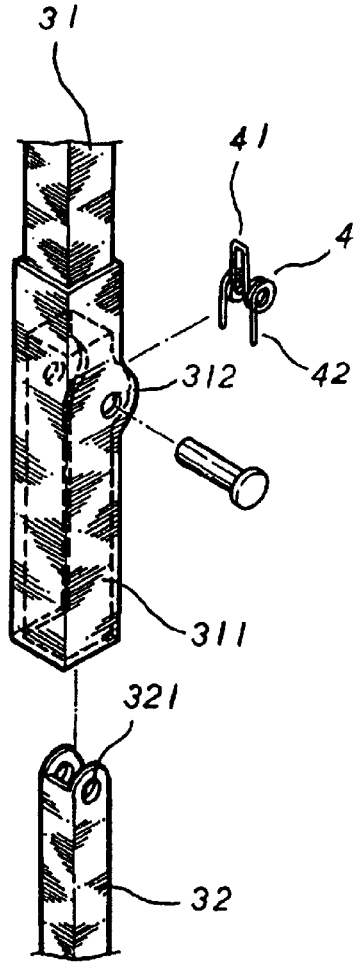
FIG. 6-B

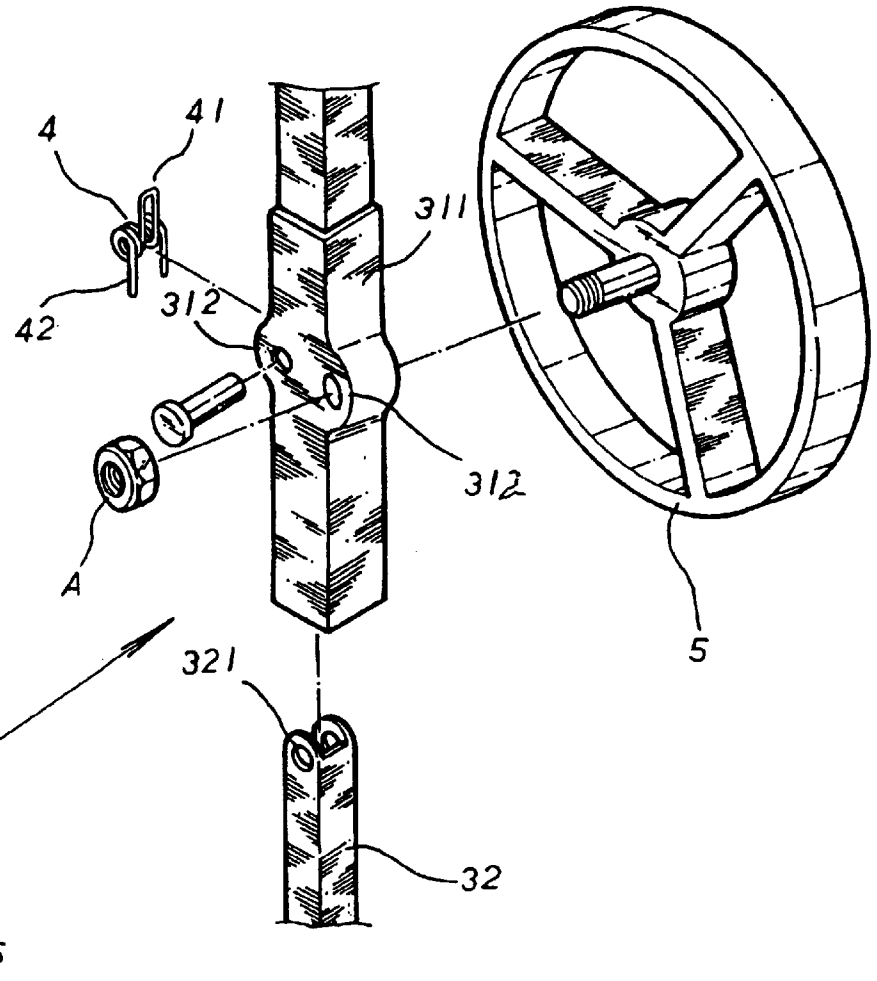
FIG. 7–B
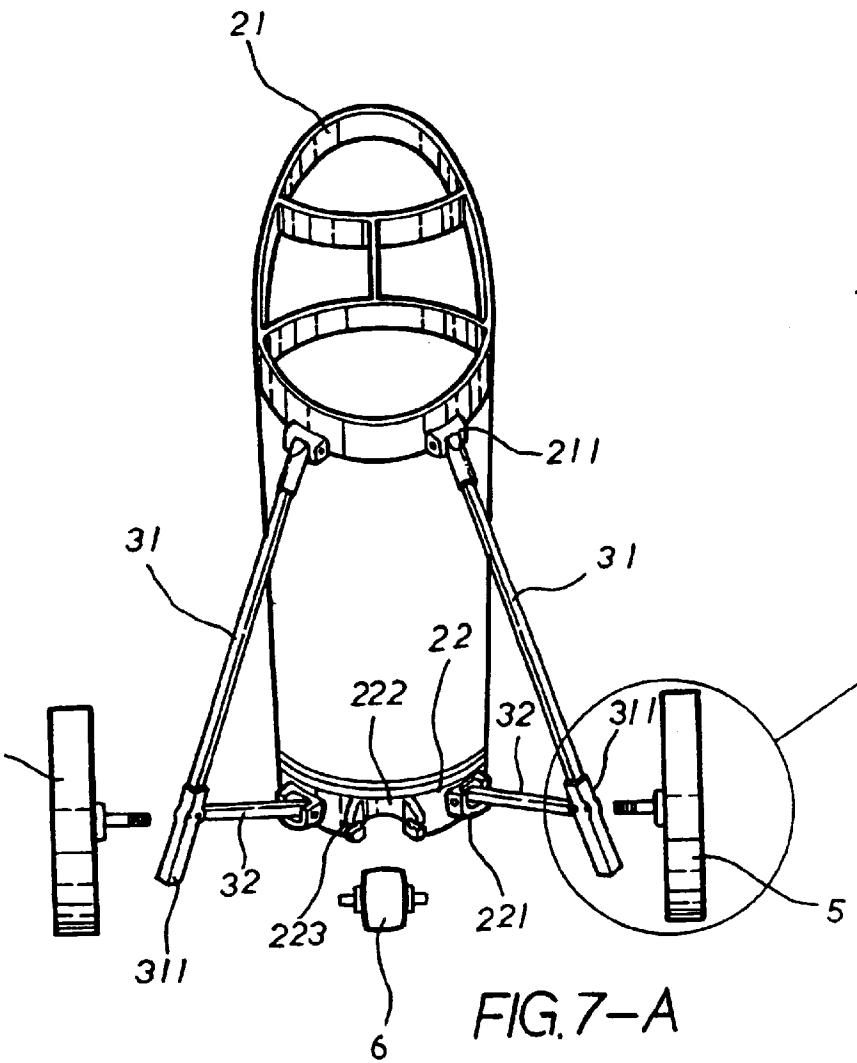
FIG. 7–A

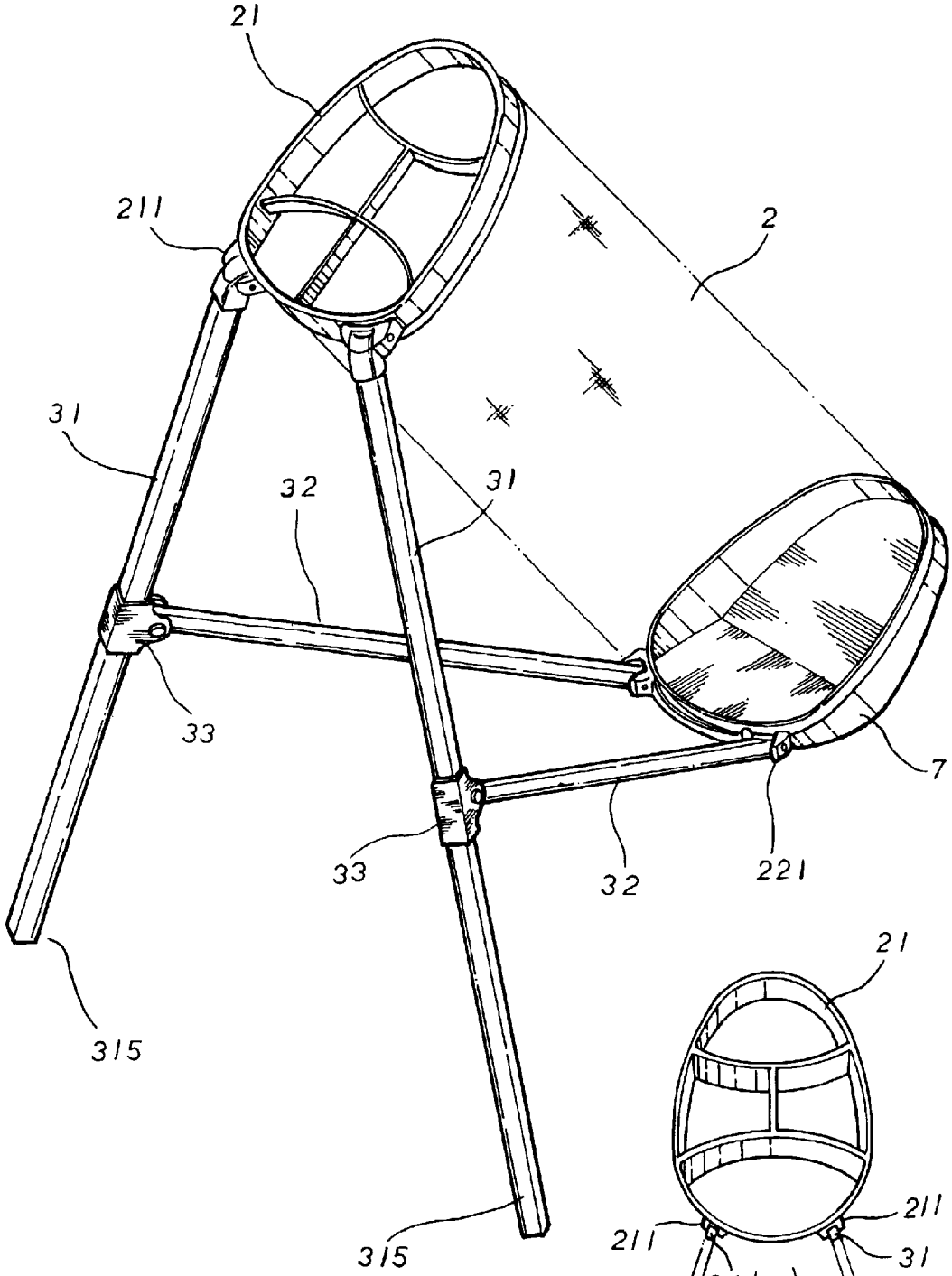
FIG.10-A
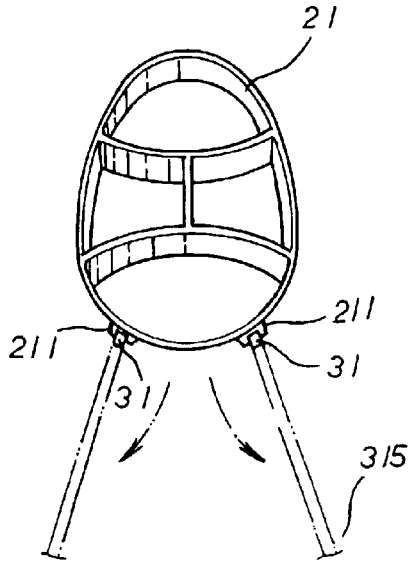
FIG.10-B

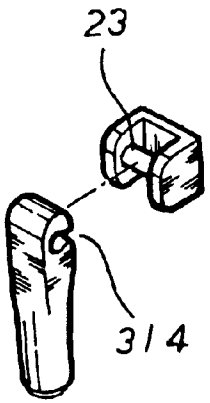
FIG. 11-A
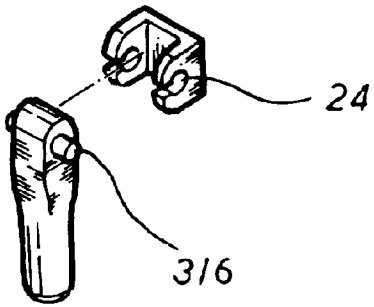
FIG. 11-B
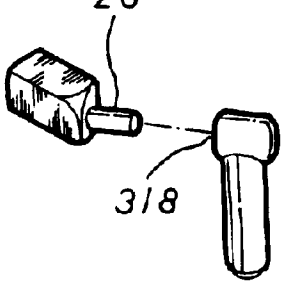
FIG. 11-C
FIG. 11-D
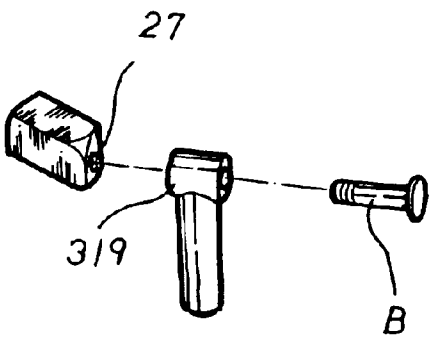
FIG. 11-E

GOLF CLUB BAG SUPPORT HAVING PIVOTAL SUPPORT MEMBERS

BACKGROUND OF THE INVENTION

1. Field of the Invention

The invention herein relates to golfing accessories, specifically an improved structure golf club bag support that maintains a golf club bag in an inclined state. Each support member is enhanced and includes a primary sub-member and a secondary sub-member, with the elasticity of a torque spring being utilized to force the primary sub-members and the secondary sub-members into a propped open, horizontal position (due to the resultant outward and downward exertion of pressure) and resiliently restoring the primary sub-members and the secondary sub-members into a straight state upon closure. In terms of practical utility, the leg extremities of the support members open outward into a pyramidical state that furnishes ample bracing in a convenient and safe manner of operation that stably postures the golf club bag and, furthermore, without occupying an excessive amount of space.

2. Description of the Prior Art

Since the sport of golf is a rewarding leisure and recreational activity that does not involve extreme athletic prerequisites, the game is suitable for a wide range of age groups. Although a high-end consumer ball sport, current levels of affluence have allowed a surprising degree of participation by the general public. However, the greatest difficulty of playing golf has to do with the issue of carrying bags containing heavy golf clubs. Since golf courses have certain number of holes along a considerable expanse of area and shouldering a weighty golf club bag requires much effort, many people employ a caddie or rent a golf cart to carry their golf clubs bags. These options no only incur an additional expense that can be quite high, but also leave golfers reliant on caddies and golf carts that are not always available when needed. In such circumstances, golfers must handle things themselves, and a round of golf is often so tiresome that any leisure and recreational value is negated. Conventional golf club bags, such as those that utilize the bag itself to stand upright, tend to fall over when placed on irregular terrain or hit, with the gravity of the impact damaging he wooden clubs. If a golf club bag is placed horizontally on the ground, this not only soils the golf club bag, but requires one to bend at the waist to access golf clubs, increasing the risk of back aches for older players. To facilitate the removal of golf clubs, some golf club bags are additionally equipped with innovative support structures. Referring to FIG. 1 and FIG. 2, the support structure of one such conventional golf club bag consists of a pair of fastening fixtures 11 disposed along the upper lateral extent of a golf club bag 1, a support rod 12 with a leg cap 121 for standing ground contact that is fitted to the first side 111 of each fastening fixture 11, a pair of tie bars 13 in union with the second sides 112, and a support mount 14 hinged to the bottom side of the said tie bars 13, with the support mount 14 positioned at the lower edge of a golf bag 1, and a clasping component 15 that is utilized to adjust the secured height of the tie bars 13. The structure is utilized by pivoting the support rods 12 outward until the tie bars 13 arrest the support rods 12 into position, thereby fully articulating the support rod 12 into an open braced posture, at which time the support rods 12 are at an include angle of θ1 or approximately 90 degrees with respect to the golf club bag 1 to provide for the placement of the golf club bag 1 in an inclined state which occupies considerable space (as shown in FIG. 2); furthermore, since the conjoined portion of the support rods 12 and tie bars 13 is adjacent to the upper edge of the golf club bag 1, it constitutes an imbalanced means of support between the support rods 12 and the corpus of the golf club bag 1 because the reinforcing relationship of the support rods 12 is insufficient and susceptible to leaning when force is applied. The structure is thus basically incapable, of providing solid support. The movability of the tie bars 13 contributes further instability and, furthermore, the leg caps 121 of the support rods 12 are so close that the tie bars 3 often snag the leg caps 121 during the prevaricated movement of the tie bars 3, which disables opening because the leg cap 121 are caught and seriously affects whether the support rods 12 are operable for purposes of buttressing. As such, the conventional structure is impractical and requires further improvement and remedies.

In view of the design and application drawbacks of the said conventional golf club bag support structure, the applicant conducted extensive research and originated progressive improvements based on professional experience gained while engaged in the golf equipment manufacturing as well as investigations into related products to address the inadequacies of the conventional products that culminated in the successful development of the structure of the invention herein which is submitted as a new patent application.

SUMMARY OF THE INVENTION

The primary objective of the invention herein is to provide an improved structure golf club bag support in which the support structure maintains a golf club bag in an inclined state, each support member enhanced and consisting of a primary sub-member and a secondary sub-member, with the elasticity of a torque spring utilized to force the primary sub-members and the secondary sub-members into a propped open, horizontal position (due to the resultant outward and downward exertion of pressure) and resiliently restoring the primary sub-members and the secondary sub-members into a straight state upon closure such that the leg extremities of the support members open outward into a pyramidical state that furnishes ample bracing in a convenient and safe manner of operation that stably postures the golf club bag and, furthermore, without occupying an excessive amount of space.

Another objective of the invention herein is to provide an improved structure golf club bag support in which the structure of the present invention forms a pyramidical support that utilizes a three-point equidistant tripodal bracing approach that achieves the objective of keeping the golf club bag standing and more difficult to topple.

Yet another objective of the invention herein is to provide an improved structure golf club bag support in which the primary sub-members of the said structure have excursive sleeve members at their bottom sides with hinge tabs that are connected to a linkage hole in the secondary sub-member as well as a locating hole that enables a nut A to be utilized for the active installation of two large wheels, which along with a small wheel installed in a recess having a pair of catch slot tabs formed in the bottom mount constitutes a three-point support having rolling capability that directly provides a means of carting the golf club bag.

Still another objective of the invention herein is to provide an improved structure golf club bag support in which the support members operate independently and, furthermore, simultaneously without interference from the snagging of the support legs to achieve the objective of the rapid and safe opening of the support structure.

To enable a further understanding of the structural features and other items of the present invention for purposes of review and reference, the brief description of the drawings below are followed the detailed description invention.

BRIEF DESCRIPTION OF THE DRAWINGS

FIG. 3–A is an exploded assembly drawing of the invention herein.

FIG. 3–B is an exploded drawing of the structure of the invention herein.

FIG. 6–A is an exploded drawing of another structural embodiment of the invention herein.

FIG. 6–B is an exploded drawing of another structural embodiment of the invention herein.

FIG. 7–A is an isometric and exploded drawing of invention herein installed onto a golf cart.

FIG. 7–B is an exploded drawing of the invention herein when wheels are installed.

FIG. 10–A is an isometric drawing of the invention herein during utilization.

FIG. 10–B is an isometric drawing of the invention herein during utilization with its support members extended.

FIG. 11–A is a drawing of the first pivoting means of the invention herein.

FIG. 11–B is a drawing of the second pivoting means of the invention herein.

FIG. 11–C is a drawing of the third pivoting means of the invention herein.

FIG. 11–D is a drawing of the fourth pivoting means of the invention herein.

FIG. 11–E is a drawing of the fifth pivoting means of the invention herein.

DETAILED DESCRIPTION OF THE INVENTION

Figure 2:
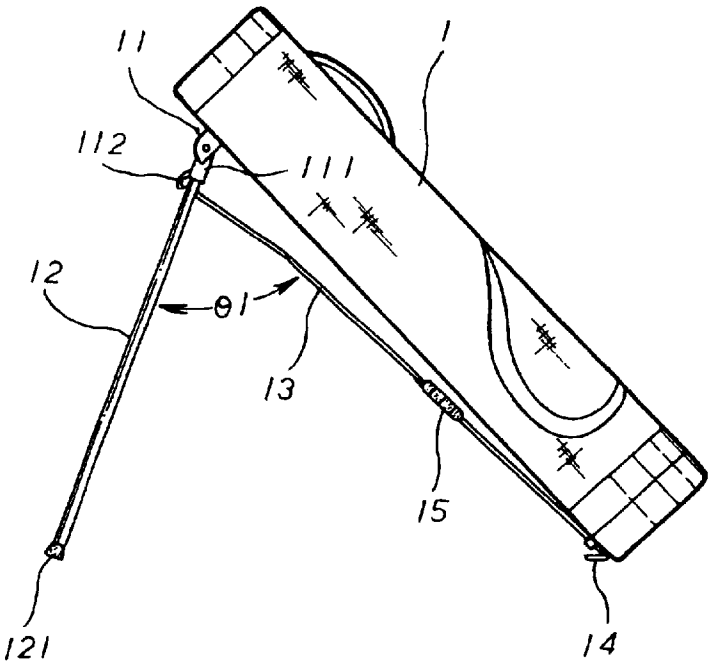
FIG. 2 PRIOR ART
FIG. 2 is an orthographic drawing of the conventional structure during utilization.
Figure 1:
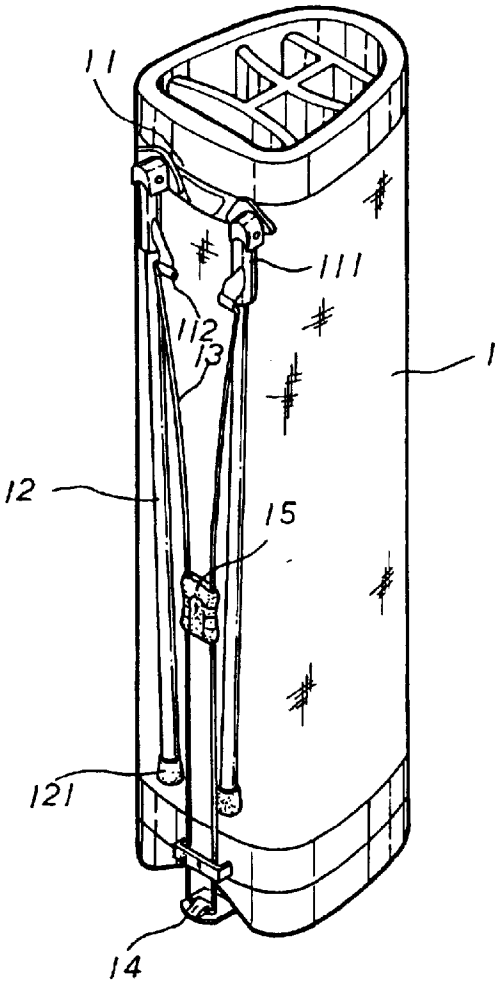
FIG. 1 PRIOR ART
FIG. 1 is an isometric drawing of a conventional structure.
Figure 4:
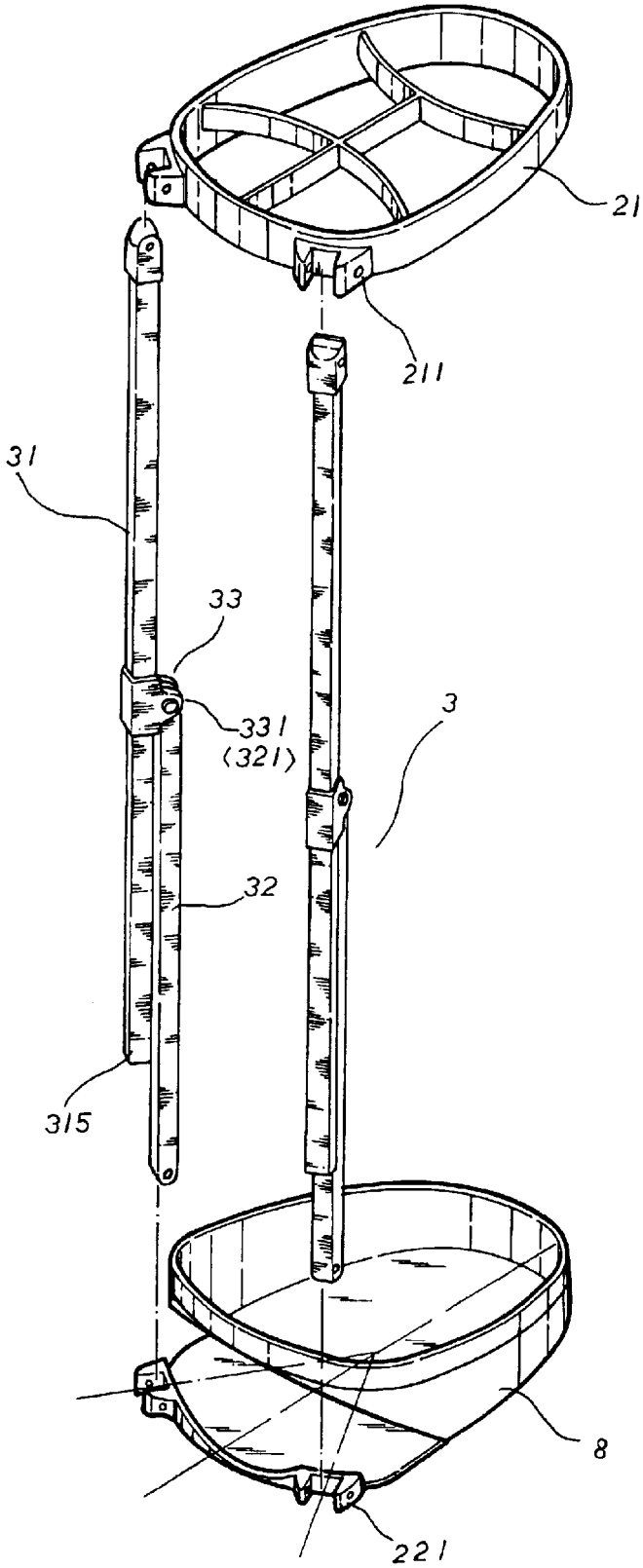
FIG. 4 is an exploded drawing of the invention herein assembled into a golf club bag with a different bottom mount.
Figure 5:
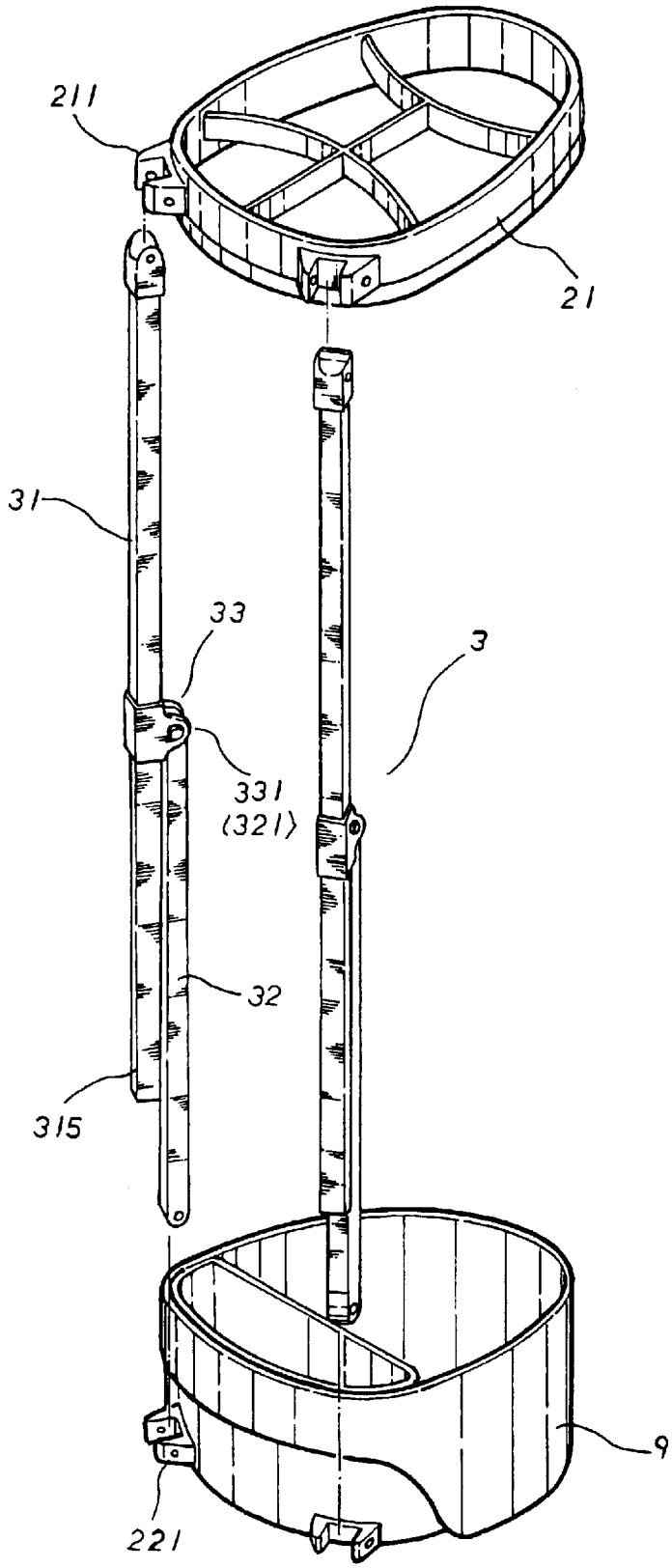
FIG. 5 is an exploded drawing of the invention herein assembled into a golf club bag with an extension-type bottom mount.
Figure 8:
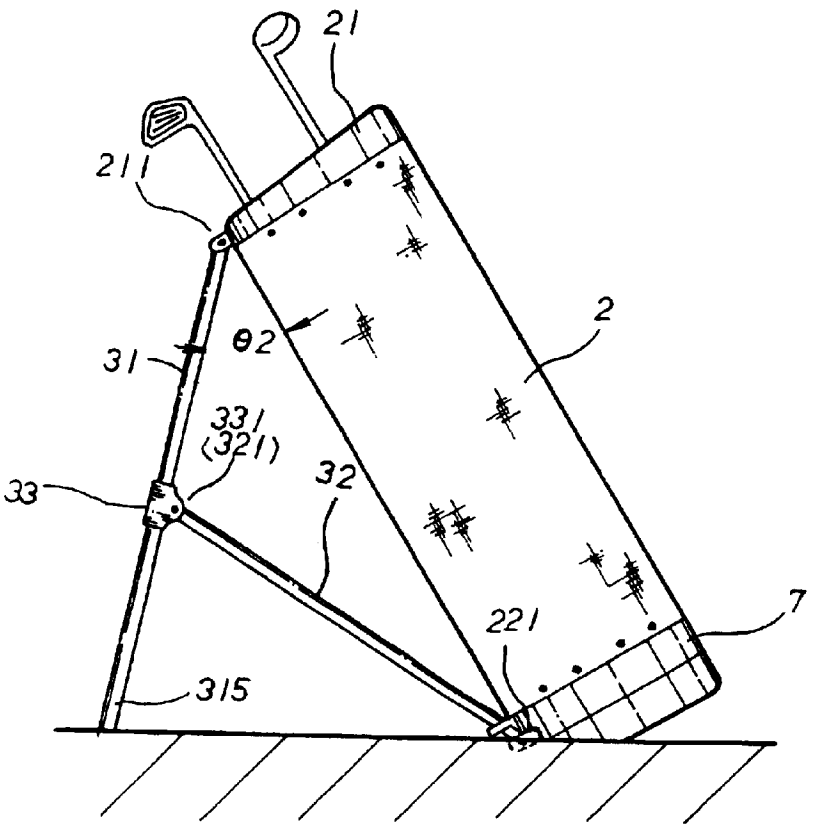
FIG. 8 is an orthographic drawing of the invention herein during utilization.

Referring to the figures, the structure of the invention herein is comprised of a golf club bag 2, opening mount 21 and bottom mount 7 having a cant-shape Two clevis sections 211 and 221 are respectively disposed at suitable intervals apart, aligned along the center lines, and, at an outwardly oriented included angle on their lateral edges. A pair of support members 3 are provide, with the top and bottom ends of which being connected to the clevis sections 21 and 221, Each support member 3 includes a primary sub-member 31 and a secondary sub-member 32. A coupling fixture 33 is disposed at the center portion of each primary sub-member 31 having hinge tabs 331 that are connected to a linkage hole 321 in the secondary sub-members 32. A positioning torque spring 4(see FIG. 3–B) is provided. The torque spring 4 has a linearly projecting upper tip 41 and lower tip 42 that are respectively situated against the primary sub members 31 and the secondary sub-members 32 such that the support members 3 are normally maintained in a straight state as though accommodating a bag (the normal arrangement during non-use, as shown in FIG. 3–A). When the invention herein is utilized as a support structure, inclining the golf club bag 2 causes the secondary sub-members 32 in the bottom mount 22 to rotate pronely at the linkage holes 321, at which time the unconnected leg extremities 315 pivot outward into the open state (as shown in FIG. 10–A) such that the primary sub-members 31 are positioned in a vertical state and the secondary sub-members 32 are positioned in a horizontal state, while the upper tips 41 and lower tips 42 of the torque spring 4 exert pressure outward and downwards, effectively producing a relatively small included angle of θ2 to form a pyramidical support that utilizes a three-point equidistant tripodal bracing approach that achieves the objective of keeping the golf club bag 2 standing and more difficult to topple (the opened support arrangement detailed in FIG. 8 and FIG. 10); Furthermore, the invention herein can also be equipped with a clamp-type bottom mount 8 and/or an extension-type bottom mount 9 for using different golf club bags 2, both of which are effectively capable of affording stable support (as shown in FIG. 4 and FIG. 5). As such, utilizing the structure of the invention herein is not limited by changes in the type of bottom mount.

Figure 9:
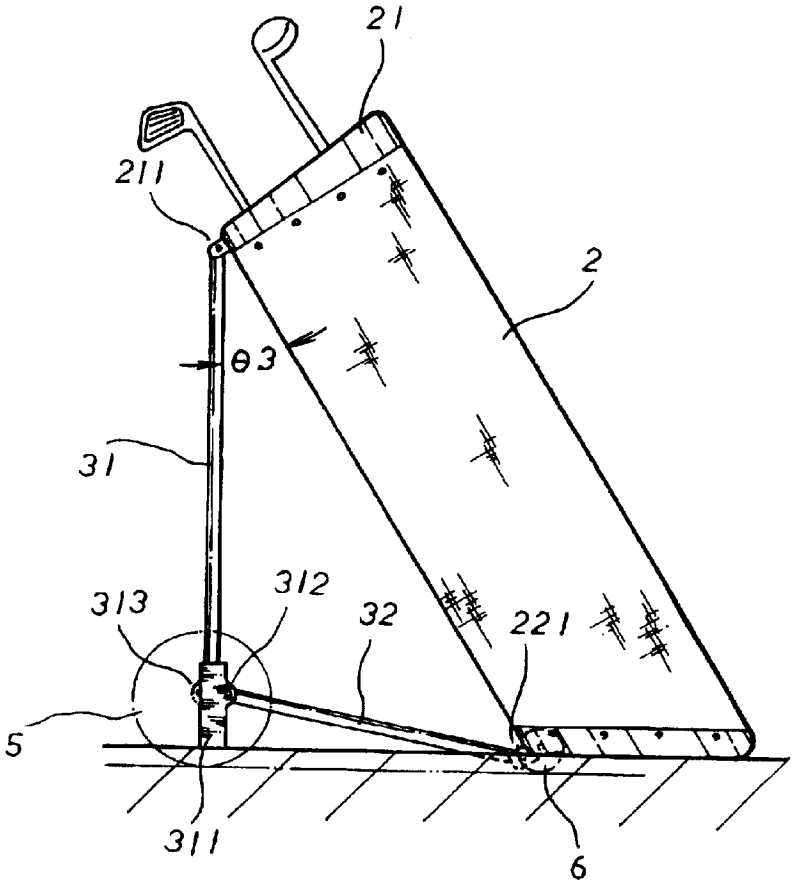
FIG. 9 is an orthographic drawing of the invention herein during utilization, but in another mode.

Additionally, the coupling fixture 33 of the invention herein can be adapted into an excursive sleeve member 311 at the bottom sides of the primary sub members 31 having hinge tabs 312 that are connected to the linkage holes 321 in the secondary sub-members 32, while also including the positioning torque spring 4(see FIG. 6–B). The torque spring 4 similarly having has a linearly projecting upper tip 41 and lower tip 42 that are respectively positioned against the primary sub-members 31 and the secondary sub-members 32 such that the support members 3 are not propped open while postured in a straightened state as though accommodating a bag (the arrangement during non-use, as shown in FIG. 6–A). When the support members 3 are propped open for use, the bottom ends of the sleeve members 311 are against the ground and a three-degree angle of support is effectively formed between them and the golf club bag 2 at a slight included angle of θ3 similar to the relatively small included angle of θ2, enabling an effectively reduce utilization space (as shown in FIG. 9). Moreover, a locating hole 313 is disposed in a wide hinge tab 312 of each sleeve member 311 of invention herein enabling a nut A to be utilized for the active installation of two large wheels 5 and, furthermore, a recess 222 having a pair of catch slot tabs 223 is formed in the bottom mount 22 for the placement of a small wheel. The large wheel 5 and small wheel 6 constitute three-point support with rolling capability that directly provides a means of carting the golf club bag 2 which can be towed about with minimal effort (the structural assembly shown in FIG. 7–A and FIG. 7–B).

What is claimed is:

1. A golf club bag support, comprising:

an opening mount disposable in an opening of a golf club bag;

a bottom mount disposable at a bottom of the golf club bag;

first and second clevises disposed on the opening mount, and on opposite sides of a center line of the golf bag support, and each being outwardly oriented at an angle;

third and fourth clevises disposed on the bottom mount, and on opposite sides of the center line of the golf bag support, and each being outwardly oriented at an angle;

first and second support members, each support member including a primary sub-member and a secondary sub-member, a top end of each primary sub-member being respectively pivotally connected to one of said first and second clevises, a bottom end of each secondary sub-member being respectively pivotally connected to one of the third and fourth clevises;

a pair of coupling fixtures, each being sleeved on a respective primary sub-member, and each having a top end of a respective secondary sub-member pivotally connected thereto; and a pair of positioning torque springs, each having a linearly projecting upper tip respectively situated against a respective primary sub-member, and a lower tip respectively situated against a respective secondary sub-member, said positioning torque springs urging the respective primary and secondary sub-members to be normally maintained in a straight line arrangement;

whereby when the golf club bag is inclined, the primary sub-members pivot outward at the respective first and second clevises, and the secondary sub-members pivot outward at the respective third and fourth clevises, so that the primary sub-members, and the secondary sub-members are articulated into a rigid pyramidical state that provides for stable support; and whereby when the golf club bag is brought fully vertical, the primary sub-members and the secondary sub-members are restored to their straight line arrangement due to the urging of the torque springs.

2. The golf club bag support recited in claim 1, wherein each coupling fixture is disposed on a center portion of a respective primary sub-member, each coupling fixture further having hinge tabs that are connected to a linkage hole in each secondary sub-member.

3. The golf club bag support recited in claim 1, wherein each coupling fixture is disposed at bottom end of a respective primary sub-member, each coupling fixture further having hinge tabs that are connected to a linkage hole in each secondary sub-member, each coupling fixture further having a locating hole that accommodates a bolt; further comprising a pair of large wheels, each being connected to a respective coupling fixture using the locating hole and the bolt, and a small wheel installed in a recess formed in the bottom mount, with the large wheels and the small wheel forming a three-point support having a rolling capability that directly provides a means of carting the golf club bag.

* * * * *